United States Patent [19]

Seki

[11] 4,434,928

[45] Mar. 6, 1984

[54] TAPE FEEDING DEVICE FOR STAPLING MACHINES

[75] Inventor: Fumio Seki, Toyama, Japan

[73] Assignee: Yoshida Logyo K K, Tokyo, Japan

[21] Appl. No.: 326,613

[22] Filed: Dec. 2, 1981

[30] Foreign Application Priority Data

Dec. 9, 1980 [JP] Japan ..... 55-176346[U]

[51] Int. Cl.[3] ..... B27F 7/19

[52] U.S. Cl. ..... 227/16; 226/156

[58] Field of Search ..... 226/76, 156, 157; 227/16

[56] References Cited

U.S. PATENT DOCUMENTS

| | | | |
|---|---|---|---|
| 1,287,684 | 12/1918 | Havener | 227/16 |
| 2,584,212 | 2/1952 | Lanegan et al. | 226/156 |
| 2,819,070 | 1/1958 | Herr | 226/156 |
| 2,947,537 | 8/1960 | Littell et al. | 226/156 |
| 3,292,837 | 12/1966 | Heil et al. | 227/16 |
| 3,733,120 | 5/1973 | Adams | 226/156 |

*Primary Examiner*—Paul A. Bell

*Attorney, Agent, or Firm*—Bucknam and Archer

[57] ABSTRACT

A stapling machine for hook-and-eye fasteners includes an improved tape feeding device which comprises a roller means having means on its circumference for continuously engaging a reinforcing tape, and means for rotating the roller means in one direction. The roller means, upon rotation, feeds a predetermined length of the tape reliably into a work station where a hook or eye fastener, a backing plate and the tape are attached to the fabric of a garment.

3 Claims, 6 Drawing Figures

TAPE FEEDING DEVICE FOR STAPLING MACHINES

BACKGROUND OF THE INVENTION

1. Field of the Invention

The present invention relates generally to stapling machines for applying hook-and-eye fastener parts to the fabric of a garment, and more particularly to a device for automatically feeding a strip of tape to be interposed between the fabric and a backing plate for reinforcing the fabric in the area of the applied fastener parts.

2. Prior Art

U.S. Pat. No. 3,292,837, patented Dec. 20, 1966 discloses a particular example of stapling machine of the type described which comprises a reinforcing tape feed mechanism including a rocker with tape drive pins pivotably mounted and urged against a slide which reciprocates with the rocker upon operation of an air cylinder. The rocker is pivoted in one of opposite directions to bring its pins into or out of driving engagement with the tape upon impinging engagement with a rearward or forward stop as the reciprocating slide reaches its rearward or forward limit. The rocker thus arranged is liable to be damaged or sometimes broken within a relatively short period of use due to repeated impinging engagement with the stops. Furthermore, as the rocker is so arranged as to feed the tape while being spring-biased into frictional engagement with the slide, it is prone to be accidentally pivoted in the direction to release the tape from the pins, therefore hindering smooth and reliable feeding of the reinforcing tape.

SUMMARY OF THE INVENTION

A tape feed means in a stapling machine for applying a fastener part with projecting prongs with a fastener backing plate to a fabric comprises a roller means having means on its circumference for continuously engaging a tape, and means for rotating the roller means in one direction. The roller means, upon rotation, feeds a predetermined length of the reinforcing tape reliably into a work station where the fastener part and backing plate are attached to the fabric.

It is an object of the present invention to provide a tape feeding device which is simple in construction and reliable in operation for feeding a reinforcing tape in the working station where a hook or eye fastener with a backing plate are attached to the fabric of a garment.

Many other advantages and features of the present invention will become manifest to those versed in the art upon making reference to the detailed description and the accompanying sheets of drawings in which a preferred structiral embodiment incorporating the principles of the present invention is shown by way of example.

DETAILED DESCRIPTION

Figure 1:
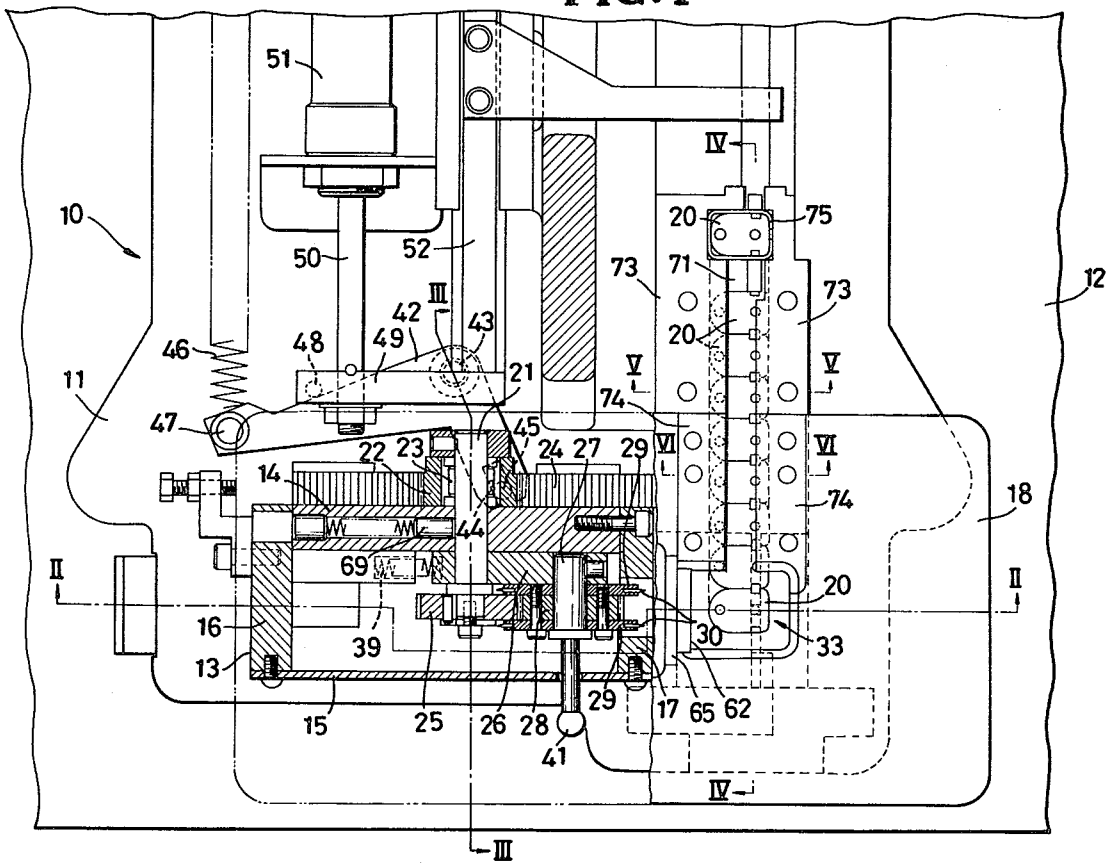
FIG. 1 is a fragmentary plan view with parts cut away of a tape feeding device constructed in accordance with the present invention.
Figure 2:
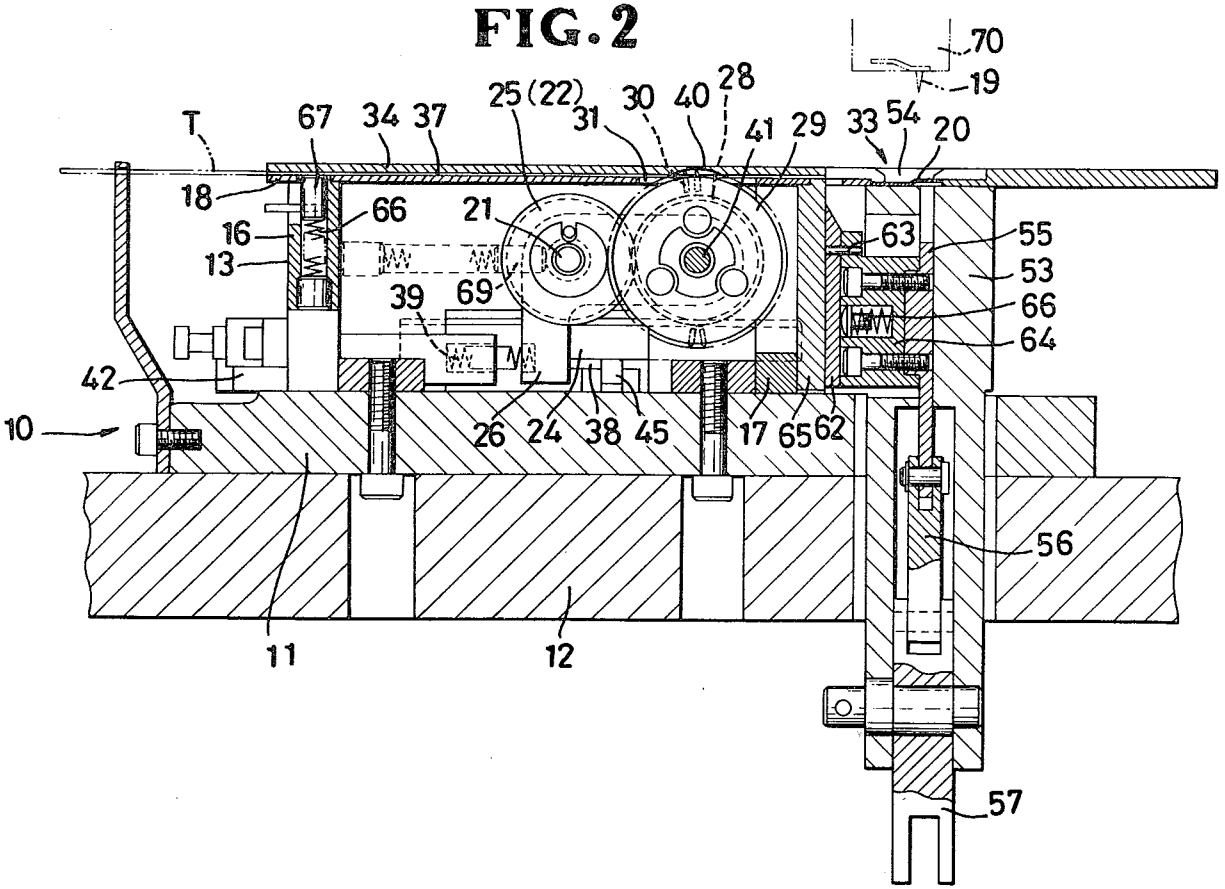
FIG. 2 is a cross-sectional view taken along line II—II of FIG. 1.

The principles of the present invention are particularly useful when embodied in a reinforcing tape feeding device such as shown in FIGS. 1 and 2, generally indicated by the numeral 10.

The reinforcing tape feeding device 10 comprises a base 11 mounted on the upper plate of a frame 12 of a stapling machine, a support block 13 mounted on the base 11 and including a pair of spaced upstanding sidewalls 14,15 and a pair of upstanding end walls 16,17 connecting the sidewalls 14,15 together to define therewith a space for containing various components of the device 10, and a substantially rectangular table 18 detachably secured by suitable fasteners to the upper face of the support block 13 for supporting the fabric of a garment (not shown) to which a hook or eye fastener part 19 with projecting prongs shown by phantom lines in FIG. 2 and a fastener backing plate 20 are attached.

Figure 3:
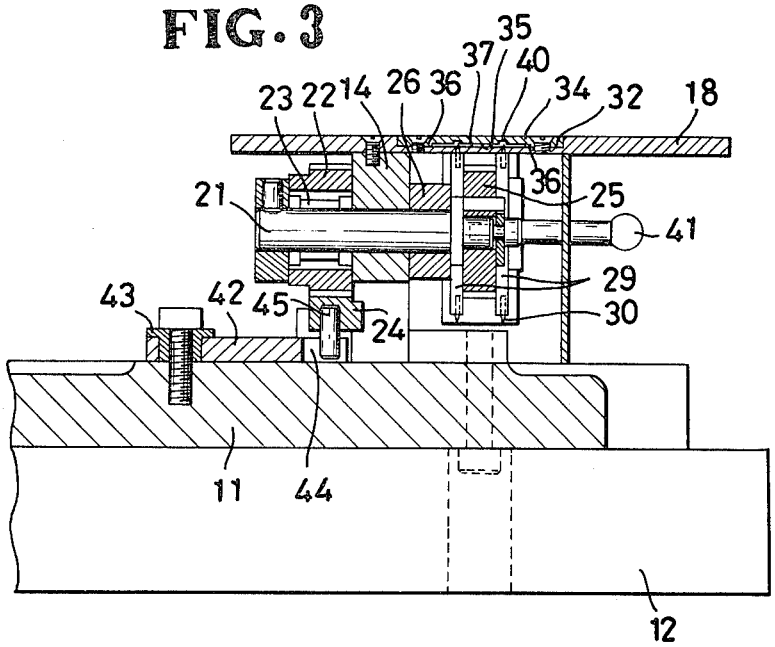
FIG. 3 is a cross-sectional view taken along line III—III of FIG. 1.

As shown in FIGS. 2 and 3, rotatably supported by the sidewall 14 of the support block 13 is a shaft 21 having a pair of end portions disposed one on each side of the sidewall 14. A pinion 22 is rotatably mounted on one or exterior end portion of the shaft 21 through a one-way clutch means such as an overrunning or free-wheeling clutch 23 which permits transmission of motion in one direction only, the pinion 22 drivingly meshing with a rack 24 slidably mounted on the base 11 for reciprocation along the sidewall 14. A drive gear 25 is fixedly secured to the other or interior end portion of the shaft 21. Pivotably mounted on the shaft 21 between the sidewall 14 and the gear 25 is a substantially inverted L-shaped lever 26 which supports on one end a shaft 27 (FIG. 1) fixed thereto and projecting therefrom toward the sidewall 15 in parallel relation to the shaft 21. A driven gear 28 and a pair of feed rollers 29,29 disposed one on each side of the driven gear 28 are rotatably mounted on the shaft 27, the rollers 29,29 being joined to the gear 28 by suitable fasteners such as bolts illustrated for corotation therewith. The drive and driven gears 25,28 are intermeshed for corotation with each other. Each of the feed rollers 29,29 has on its circumference a row of pointed projections or needles 30 extending radially outwardly therefrom and spaced circumferentially apart from each other. As best shown in FIG. 2, the feed rollers 29,29 are received in an opening 31 formed in the table 18 for purposes to be hereinafter described.

As shown in FIGS. 2 and 3, the table 18 has on its upper side a groove 32 (FIG. 3) extending longitudinally from one end thereof through and over the support block 13 to a work station 33 where the hook or eye 19 and the backing plate 20 are attached to the fabric. Placed in the groove 32 is a cover plate 34 which has on its underside an elongated groove 35 formed by and between a pair of ridges 36,36, the groove 34 extending in longitudinal alignment with the groove 32. The cover plate 34 as fixed in the groove 32 and secured to the table 18 by screws provides with the table 18 an elongated guideway 37 through which a tape T is fed as from a reel of tape (not shown). The guideway 37 extends normal to the shafts 21,27, over the gears 25,28 and the feed rollers 29,29 in alignment therewith. The cover plate 34 may be replaced with any one of other cover plates each having a groove different in width and depth from those of the groove 35 so as to be adapted for guiding tapes with varying width and thickness.

As best shown in FIG. 2, another end of the support lever 26 is urged by a compression spring 39 against a stop 38 to retain the feed rollers 29,29 in their normal positions in which the pointed projections 30 extend through the guideway 37 into arcuate recesses 40 formed in the groove 35 to ensure that the projections 30 completely pierce the tape T. The shaft 27 has an integral handle 41 extending outwardly beyond the sidewall 15 of the guide block 13. The downward movement as viewed in the drawings, of the handle 41 causes the support lever 26 to rotate in the clockwise direction as viewed in FIG. 2 against the force of the spring 39, thereby descending the pointed projections 30 downwardly away from the guideway 37.

A bell crank 42 is pivotably mounted on the base 11 by a bushing or shaft 43 fixed to the base 11 and is connected to the rack 24 through a radial slot 44 formed in the end of one arm of the bell crank 42 and a depending pin 45 fixed to the rack 24 and received in the slot 44. A tension spring 46 is connected between a pin 47 fixed to the end of another lever of the bell crank 42 and the base 11, and urges the bell crank 42 in the clockwise direction as viewed in FIG. 1 against a depending pin 48 fixed to an arm 49. The arm 49 is disposed above the bell crank 42 and connected to the outer end of an operating rod 50 of an air cylinder 51 mounted on the base 11. A slide rod 52 is connected to the arm 49 and reciprocable with the arm 49 so as to actuate a parts supplying mechanism (not shown) for supplying fastener parts such as hook or eye fasteners and backing plates to the work station 33 one at a time.

Figure 4:
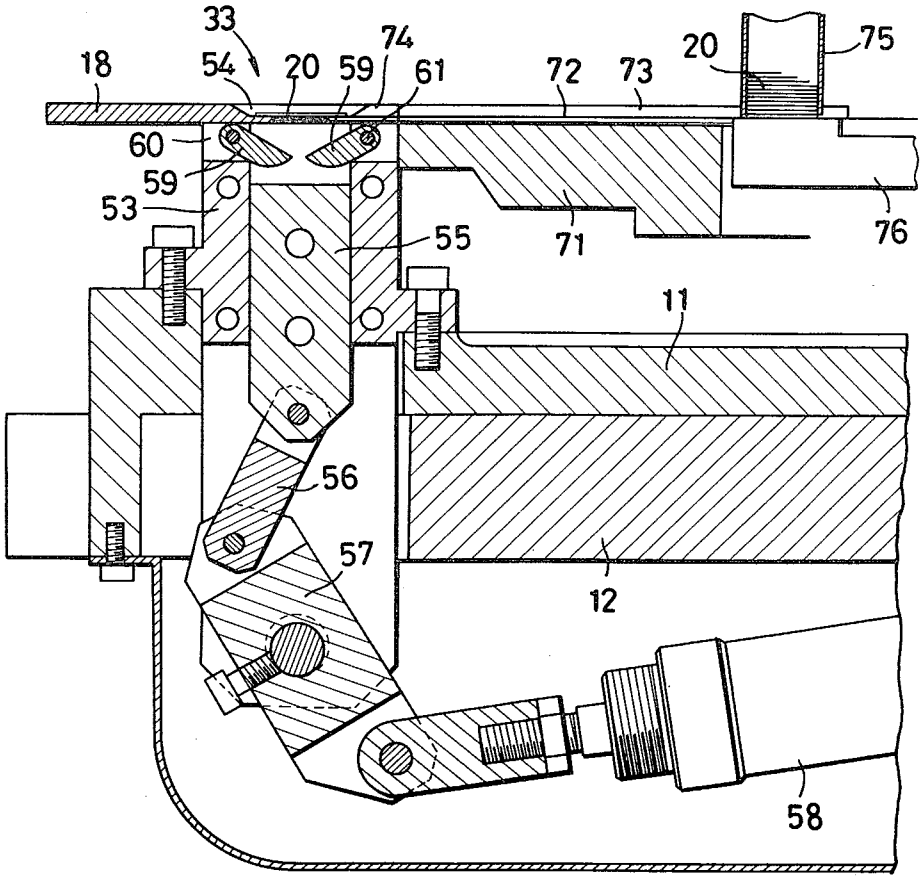
FIG. 4 is a cross-sectional view taken along line IV—IV of FIG. 1.

As shown in FIGS. 2 and 4, the work station 33 includes a punch guide 53 mounted on the base 11 in substantially vertical alignment with an opening 54 in the table 11. A lower punch 55 is slidably mounted within the punch guide 53 and operatively connected through link members 56,57 to an air cylinder 58 for reciprocation therewith. A pair of anvil links 59,59 (FIG. 4) is mounted within a slot 60 formed in the top of the punch guide 53 for pivotal movement about their respective pivot pins 61,61 in the plane of the lower punch 55 and is thereby adapted to be pivoted upwardly by the lower punch 55 to engage and thereby bend the downwardly projecting prongs of the hook or eye fastener 19 to secure the fastener 19 with the backing plate 20 to the fabric. An upstanding shear blade 62 (FIG. 2) is loosely supported by pins 63 fixed to a mounting block 64 secured to the lower punch 55, the shear blade 62 being urged against a shear plate or die 65 by a spring-biased plunger 66. The shear blade 62 thus arranged reciprocates with the lower punch 55 along the shear plate 65 upon operation of the air sylinder 58.

Prior to the operation of the tape feeding device 10, a tape T is introduced into the guideway 37 toward the working station 33 with the projections 30 on the respective rollers 29,29 being descended downwardly away from the guideway 37 by depressing the handle 41. The tape is preferably lightly restrained within the guideway 37 as by a plunger 67 biased by a spring 68. Upon releasing the handle 41 the feed rollers 29,29 return to their normal positions and projections 30,30 thereon completely pierce the tape T.

For the purposes of illustrations, the cycle of operation begins with the tape feeding device 10 held in the position shown in FIG. 1 in which the operating rod 50 of the air cylinder 51 is fully extended against the force of the tension spring 46. When the air cylinder 51 is operated to withdraw its operating rod 50 and hence the arm 49, the bell crank 42 rotates in the clockwise direction as viewed in FIG. 1 with the aid of the tension spring 25, whereupon the rack 24 slides to the left as viewed in FIGS. 1 and 2. During that time, the overrunning clutch 23 allows the pinion 22 to rotate freely of its own accord in the clockwise direction as viewed in FIG. 2 and prevents transmission of motion from the pinion 22 to the shaft 21. A spring-biased plunger 69 serves to protect the shaft 21 from being rotated in the counterclockwise direction under the frictional forces which might be exerted as the pinion rotates.

As the air cylinder 51 is operated to extend the operating rod 50 and hence the arm 49, the bell crank 42 rotates in the counterclockwise direction as viewed in FIG. 1 whereupon the rack 24 moves to the right as viewed in FIGS. 1 and 2 and drives the pinion 21 to rotate in the counterclockwise direction as viewed in FIG. 2. During that time the overrunning clutch 23 acts to transmit the motion of the pinion 22 to the shaft 21, permitting corotation of the shaft 21 and hence the drive gear 25 with the pinion 22 in the counterclockwise direction. The gear 28 is therefore driven by the drive gear 25 to rotate in the clockwise direction whereupon a predetermined length of the tape T is fed to the right as viewed in FIG. 2 in and along the guideway 37 into the working station 33 by means of the pointed projections 30 that are continuously brought into driving engagement with the tape T.

After the length of tape T has been supplied over the lower punch 55 at the working station 33, a ram or upper punch 70 on which is supported a hook or eye fastener 19 with prongs is driven downwardly by a suitable driving means (not shown) to drive the fastener 19 through the fabric of a garment and the tape T underlying the fabric and into cooperative association with a backing plate 20 positioned for receiving the fastener. Thereafter the lower punch driven upwardly by the air cylinder 58 to force the fastener prongs into engagement with the anvil links 59,59 for bending the fastener prongs about the backing plate 20. Substantially simultaneously therewith, the shear blade 64 cuts the length of tape away.

Figure 5:
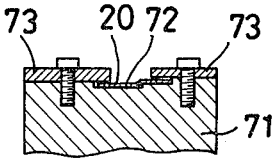
FIGS. 5 and 6 are cross-sectional views taken along lines V—V and VI—VI of FIG. 1, respectively.
Figure 6:
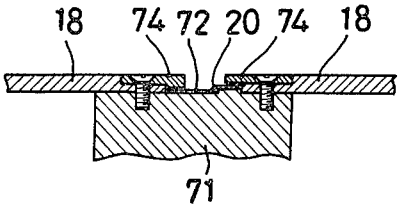

The backing plates 20 are succesively fed over the lower punch 55 positioned at the work station 33 in and along a guide groove 72 (FIGS. 5 and 6) formed in a guide block 71 which is connected to the punch guide 53 in alignment with the work station 33 but extends normal to the guideway 37 for tape T. As best shown in FIG. 5, a pair of cover plates 73,73 are secured directly to the guide block 71 and disposed one on each side of the guide groove 72 in overhanging relation with the guide groove 72 to positively hold the backing plates 20 in the groove 72 against displacement thereoff. Contiguous to the cover plates 73,73, another pair of cover plates 74,74 are secured to the guide block 71 via the table 18 and disposed one on each side of the guide groove 72. In the latter case, the guide groove 72 is formed jointly with the guide block 71 and the table 18, as shown in FIG. 6. Designated by the numeral 75 in FIGS. 1 and 4 is a magazine for storing therein a stack of backing plates 20 and the reference numeral 76 in FIG. 6 denotes a pusher for pushing the backing plates 20 successively one at a time toward the work station 33.

Although a certain preferred structual embodiment of the invention has been described in detail, obviously, many modifications and variations of the present invention are possible in the light of the above teachings. It is therefore to be understood that within the scope of the appended claims, the invention may be practiced otherwise than as specifically described.

As for an example, the rack 24 may be driven directly by the air cylinder 51. As an alternative, a motor means may be used to rotate the feed rollers 29,29 directly in one direction. The pointed projections 20 on the feed rollers 29,29 may be substituted by teeth or rubbers provided circumferentially on the respective feed rollers 29,29.

What is claimed is:

1. In a stapling machine for applying a fastener part with projecting prongs with a fastener backing plate to a fabric, having means for applying a fastener part with a backing plate to the fabric a work station, and means for feeding a reinforcing tape into the work station in overlying relation to the backing plate, the improvement wherein the tape feed means comprises a roller means having means on its circumference for continuously engaging the tape, and means for rotating said roller means in one direction, said roller means, upon rotation, feeding a predetermined length of the reinforcing tape into the work station and wherein said rotating means comprises an air cylinder, a rack operatively connected to said air cylinder for reciprocating movement when said air cylinder is operated to rotate a bell crank connected to said rack, a pinion rotatable in its own axis and drivingly meshing with said rack, a drive gear coaxial with said pinion, a one-way clutch means in said pinion for transmitting motion of said pinion to said drive gear, a driven gear rotatable in its own axis and drivingly meshing with said drive gear, said roller means comprises a pair of feed rollers coaxially connected to and disposed one on each side of said driven gear, and said means on said roller means comprises a pair of axially spaced rows of pointed projections extending radially outwardly from the respective circumferences of said feed rollers and spaced circumferentially apart from each other.

2. The improvement according to claim 1, comprising means providing a guideway in alignment with the work station for guiding the tape forwardly into a predetermined relation to the applying means, said means on said roller means being normally urged to be located in said guideway.

3. The improvement according to claim 2, wherein the width and thickness of said guideway may be varied by use of different cover plates having grooves different in width and depth.

* * * * *

UNITED STATES PATENT AND TRADEMARK OFFICE

CERTIFICATE OF CORRECTION

PATENT NO. : 4,434,928

DATED : March 6, 1984

INVENTOR(S) : Fumio Seki

It is certified that error appears in the above-identified patent and that said Letters Patent is hereby corrected as shown below:

On the title page assignee should read -- Yoshida Kogyo K K, Tokyo, Japan --.

Signed and Sealed this

*Third* Day of *July 1984*

[SEAL]

*Attest:*

GERALD J. MOSSINGHOFF

*Attesting Officer*

*Commissioner of Patents and Trademarks*